US005673552A

United States Patent [19]

Idleman et al.

[11] Patent Number: 5,673,552

[45] Date of Patent: Oct. 7, 1997

[54] FUEL INJECTION NOZZLE

[75] Inventors: Dennis D. Idleman, Lakeside; Kenneth O. Smith, San Diego, both of Calif.

[73] Assignee: Solar Turbines Incorporated, San Diego, Calif.

[21] Appl. No.: 625,602

[22] Filed: Mar. 29, 1996

[51] Int. Cl.[6] ..... F02C 9/00

[52] U.S. Cl. ..... 60/39.23; 60/748

[58] Field of Search ..... 60/737, 742, 748, 60/39.23, 39.29

[56] References Cited

U.S. PATENT DOCUMENTS 5,230,212 7/1993 Forestier ..... 60/748

5,309,709 5/1994 Cederwall et al. ..... 60/39.23

5,457,953 10/1995 Etheridge ..... 60/39.23

FOREIGN PATENT DOCUMENTS 398488 7/1924 Germany ..... 60/748

*Primary Examiner*—Charles G. Freay

*Attorney, Agent, or Firm*—Larry G. Cain

[57] ABSTRACT

A fuel injection nozzle includes a first cavity having a first preestablished cross-sectional area and a second preestablished cross-sectional area being larger than the first preestablished cross-sectional area. And, an actuating device being positioned at an inlet end of the first cavity and controllably varying the flow of a compressed fluid through the fuel injection nozzle. The fuel injection nozzle further including a second cavity having a flow of compressed fluid flowing therethrough.

31 Claims, 4 Drawing Sheets

FUEL INJECTION NOZZLE

TECHNICAL FIELD

This invention relates generally to a gas turbine engine and more particularly to a fuel injection nozzle for reducing emissions by controlling the primary air induced into the combustion system of a gas turbine engine.

BACKGROUND ART

The use of fossil fuel in gas turbine engines results in the combustion products consisting of carbon dioxide, water vapor, oxides of nitrogen, carbon monoxide, unburned hydrocarbons, oxides of sulfur and particulates. Of these above products, carbon dioxide and water vapor are generally not considered objectionable. In most applications, governmental imposed regulations are further restricting the remainder of the species, mentioned above, emitted in the exhaust gases.

The majority of the products of combustion emitted in the exhaust can be controlled by design modifications, cleanup of exhaust gases and/or regulating the quality of fuel used. For example, particulates in the engine exhaust have been controlled either by design modifications to the combustor and fuel injectors or by removing them by traps and filters. Sulfur oxides are normally controlled by the selection of fuels that are low in total sulfur. This leaves nitrogen oxides, carbon monoxide and unburned hydrocarbons as the emissions of primary concern in the exhaust gases emitted from the gas turbine engine.

The principal mechanism for the formation of oxides of nitrogen involves the direct oxidation of atmospheric nitrogen. The rate of formation of oxides of nitrogen by this mechanism depends mostly upon the flame temperature and to some degree upon the concentration of the reactants and, consequently, a small reduction in flame temperature can result in a large reduction in the nitrogen oxides.

Attempts to control NOx emissions by regulating the local flame temperature have adopted the use of water or steam injection. This system increases cost due to the additional equipment, such as pumps, lines and storage reservoir. Furthermore, in areas where a supply of water is not readily available the cost and labor to bring in water basically makes this option undesirable.

In an attempt to reduce NOx emissions without incurring increase in operational cost caused by water or steam injection, gas turbine combustion systems have utilized a variety of approaches including premix systems and various fuel injector designs. These premix system and nozzles used therewith are examples of attempts to reduce the emissions of oxides of nitrogen. The systems and nozzles described above although improving the emissions of oxides of nitrogen emitted from the engine exhaust have failed to efficiently reduce emissions of oxides of nitrogen emitted from the engine exhaust.

DISCLOSURE OF THE INVENTION

In one aspect of the invention, a fuel injection nozzle defines an axis and includes a first cavity centered about the axis and defines an inlet end and an outlet end. The first cavity has a first preestablished cross-sectional area positioned near the inlet end and a second preestablished cross-sectional area positioned near the outlet end. A fueling device, through which fuel is introduced into the first cavity is positioned in the first preestablished cross-sectional area of the first cavity. A swirling device through which a combustion air is swirled prior to having fuel introduced into the combustion air is positioned within the first preestablished cross-sectional areas of the first cavity. A second cavity is centered about the axis and is positioned radially inwardly from the first cavity. The second cavity, during operation of the fuel injection nozzle, has a flow of combustion air flowing through the second cavity. And, an actuating device is positioned radially about the second cavity and defines an open position and a closed position. The actuating device is operatively movable to a plurality of preestablished positions between the open position and the closed position. The actuating device is positioned at the inlet end of said first cavity.

In another aspect of the invention, a gas turbine engine includes a housing having a compressor section, a turbine section and a combustion section being operative interposed the compressor section and the turbine section positioned therein. A fuel injection nozzle is in communication with the combustor section and a source of fuel. A plenum (31) is in communication with the compressor section, the combustor section and the fuel injection nozzle. The plenum is supplied with a compressed fluid to be mixed with the fuel within the fuel injection nozzle prior to entering into the combustion section. The fuel injection nozzle includes an axis, a first cavity centered about the axis and defines an inlet end and an outlet end. The first cavity has a first preestablished cross-sectional area positioned near the inlet end and a second preestablished cross-sectional area positioned near the outlet end. A first fueling device through which fuel is introduced into the first cavity is positioned in the first preestablished cross-sectional area of the first cavity and a swirling device is positioned within said first preestablished cross-sectional areas (112) of said first cavity. A second cavity is centered about the axis and is positioned radially inwardly from the first cavity. And, an actuating device is positioned at the inlet end of the first cavity and defines an open position and a closed position. The actuating device is operatively movable to a plurality of preestablished positions between the open position and the closed position.

BEST MODE FOR CARRYING OUT THE INVENTION

Figure 1:
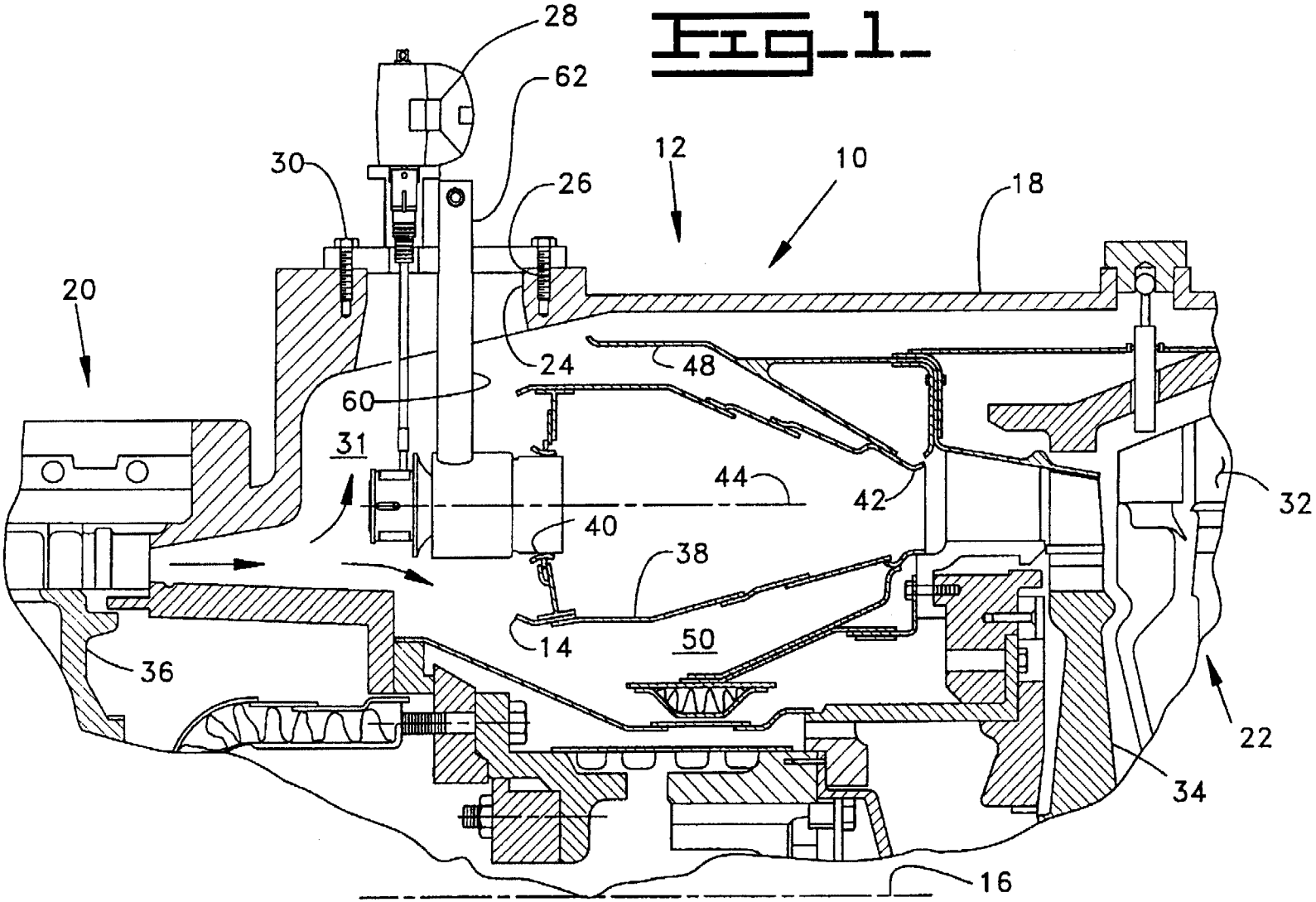
FIG. 1 is a sectional side view of a portion of a gas turbine engine embodying the present invention.

In reference to FIG. 1, a gas turbine engine 10 includes a combustor section 12 having an axial, in line, annular combustor 14 positioned therein. As an alternative to the axial, in line, annular combustor 14, the combustor section 12 could include any type of combustor such as a side mounted combustor or a plurality of can-type combustors without changing the essence of the invention. The gas turbine engine 10 has a central axis 16 and an outer housing 18 coaxially positioned about the central axis 16. The housing 18 is positioned about a compressor section 20 centered about the axis 16 and a turbine section 22 is centered about the axis 16. The combustor section 12 is positioned operatively between the compressor section 20 and the turbine section 22. Positioned within the housing 18 intermediate the compressor section 20 and the turbine section 22 is an opening 24 having a plurality of threaded holes 26 positioned therearound. A fuel injection nozzle 28 is conventionally positioned within the opening 24 and attached to the housing 18 by a plurality of bolts 30 engaged in the threaded holes 26. Thus, the fuel injection nozzle 28 is removably attached to the gas turbine engine 10 and is positioned with a plenum 31 within the housing 18. The plenum 31 is in communication with the compressor section 20, the combustor section 12 and the fuel injection nozzle 28.

The turbine section 22 includes a power turbine 32 having an output shaft, not shown, connected thereto for driving an accessory component such as a generator. Another portion of the turbine section 22 includes a gas producer turbine 34 connected in driving relationship to the compressor section 20. The compressor section 20, in this application, includes an axial staged compressor 36. When the engine 10 is operating, the compressor 36 causes a flow of compressed air to be used for combustion and cooling purposes. As an alternative, the compressor section 20 could include a radial compressor or any source for producing compressed air.

As further shown in FIG. 1, the combustor section 12 includes a multi piece combustor liner 38 having an inlet opening 40 and an outlet opening 42 therein. The combustor liner 38 is supported within the engine 10 in a conventional manner. Compressed air from the compressor section 20 is communicate to the plenum 31 and is used for cooling the external portion of the combustor liner 38 and a portion of the compressed air is channeled through the fuel injector nozzle 28 mixed with fuel, burn within the combustor section 12 and exits the outlet opening 42 to the turbine section.

Figure 2:
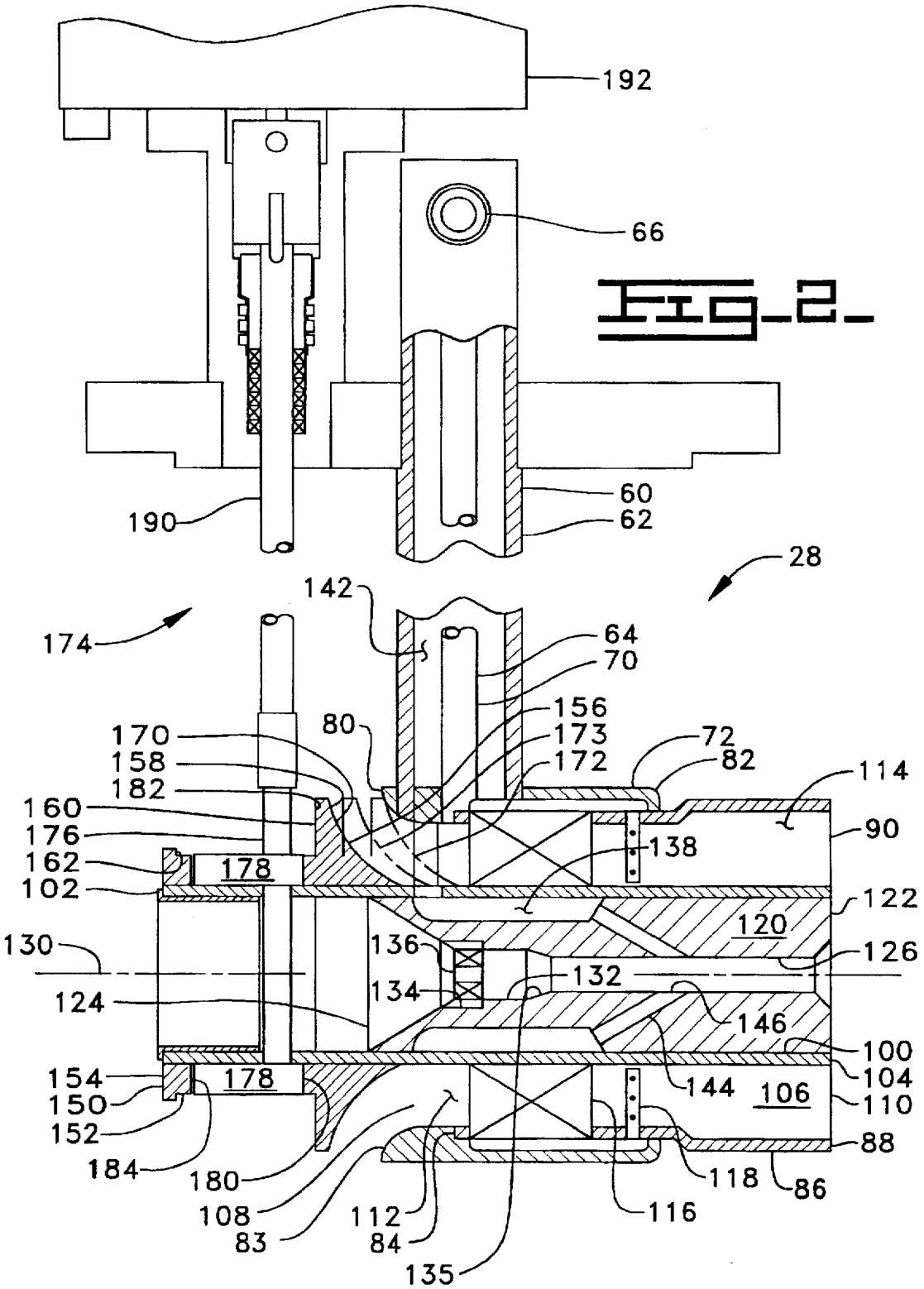
FIG. 2 is an enlarged sectional view of a fuel injection nozzle.

As best shown in FIG. 2, the fuel injection nozzle 28 includes a support portion 60 having a cylindrical outer shell 62 positioned in the opening 24 within the housing 18. In this application, positioned within the shell 62 is a gaseous fuel tube 64 which is in communication with a supply of gaseous fuel at an inlet end portion 66. As an alternative, the shell 62 could include a liquid fuel tube, not shown. An outlet end portion 70 of the gaseous fuel tube 64 is in communication with a first housing 72. The first housing 72 has a generally channel shaped cross-section having a cylindrical configuration. The first housing 72 includes a first end portion 80 and a second end portion 82. In this application, the extremity of the first end portion 80 has an arcuate configuration defining a sealing portion 83 being defined by a preestablished radius. A first end 84 of a second housing 86 is positioned within the first housing 72 in sealing relationship to the second end portion 82 of the first housing 72. The second housing 86 has a cylindrical configuration having a second end 88 axially extending from the second end portion 82 of the first housing 72 a preestablished distance and forms an outlet end portion 90 of the fuel injection nozzle 28. Positioned within the second housing 86 is a third housing 100 having a first end 102 which axially extends beyond the end portion 80 of the second housing 86 and a second end 104 which is in axial alignment with the second end 88 of the second housing 86. Formed between the second housing 86 and the third housing 100 is a first annular cavity 106 defining an inlet end 108 and an outlet end 110 generally corresponding to the outlet end portion 90 of the fuel injection nozzle 28. In this application, the first cavity 106 has a first preestablished cross-sectional area 112 near the inlet end 108 and a second preestablished cross-sectional area 114 near the outlet end 110 which is greater than the first preestablished cross-sectional area 112. The first preestablished cross-sectional area and the second preestablished cross-sectional area has a transition area therebetween. A swirling device or a plurality of swirler vanes 116 are positioned within the first preestablished area 112 of the first cavity 106. And a fueling device or a plurality of spoke members 118 being in fluid communication with the fuel within the gaseous fuel tube 64 are also positioned within the first preestablished area 112 of the first cavity 106 intermediate the plurality of swirler vanes 116 and the outlet end 110. The second preestablished area or cross-sectional area 114 is interposed the transition area and the outlet end 110. Positioned within the third housing 100 is a core member 120 having a first end 122 being axially aligned with the outlet end portion 90 of the fuel injection nozzle 28 and a second end 124 interposed the first end 102 and the second end 104 of the third housing 100. The core member 120 has a through bore 126 centered therein about an injector axis 130 which forms a portion of a second cavity 132. The remainder of the second cavity 132 is formed within the spacing between the second end 124 of the body member 120 and the first end 102 of the third housing 100. The second cavity 132 is positioned radially inwardly from the first cavity 106 and is in communication with the plenum 31. The through bore 126 has a chamfered contour at the first end 122 and the through bore 126 has a frustoconical contour at the second end 124 which extends from the extremity of the core member 120 to the diameter of the through bore 126. The through bore 126 has an increased diameter portion or step 134 therein being interposed the frustoconical contour at the second end 124 and the first end 122. At an end of the step 134 nearest the first end 122 is a transition portion 135. A plurality of swirler vanes 136 are positioned within the step 134. An annular reservoir 138 is formed between the core member 120 and the third housing 100. The annular reservoir 138 is in fluid communication with a fuel passage 122 positioned within the outer shell 62. The fuel passage 142 is in fluid communication with a source of gaseous fuel, not shown. A plurality of cross drilled holes 144 communicate between the annular reservoir 138 and the through bore 126. An end 146 of the plurality of drilled holes 144 exiting into the through bore 126 and is positioned intermediate the transition portion 136 and the first end 122. The axis of the plurality of drilled holes 144 are biased the injector axis 130 and functionally direct fuel toward the outlet end portion 90 of the fuel injection nozzle 28.

Figure 3:
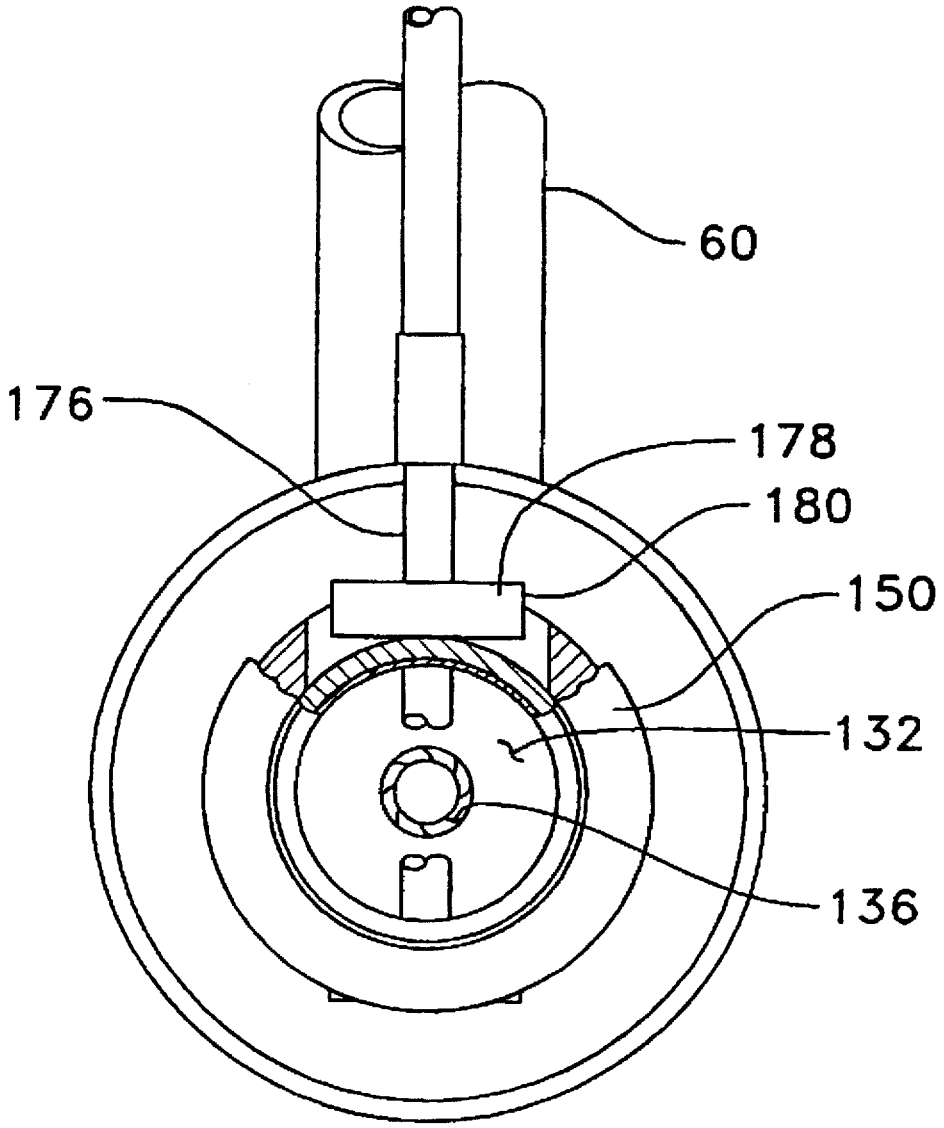
FIG. 3 is an enlarged sectional view of a portion of the fuel injection nozzle taken along line 3—3 of FIG. 2.

Slidably positioned about the third housing 100 is a plunger 150. The plunger 150, as further shown in FIG. 3, is constructed of a generally cylindrical body 152 defining a first end portion 154 nearest the first end 102 of the third housing 100. And, a second end portion 156 having a generally frustoconical configuration. The generally frustoconical configuration has an arcuate surface thereon defining a sealing portion 158 being defined by a preestablished radius. .The sealing portion 158 of the frustoconical configuration of the plunger 150 has a preestablished radius being substantially equal to the preestablished radius of the sealing portion 83 of the end portion 80 of the first housing 72. As an alternative, the arcuate surface of the frustoconical configuration at the second end portion 156 could be defined by a straight surface. A first shoulder 160 is positioned intermediate the first end portion 154 and the second end portion 156. A second shoulder 162 is positioned intermediate the first shoulder 160 and the first end portion 154.

Figure 4:
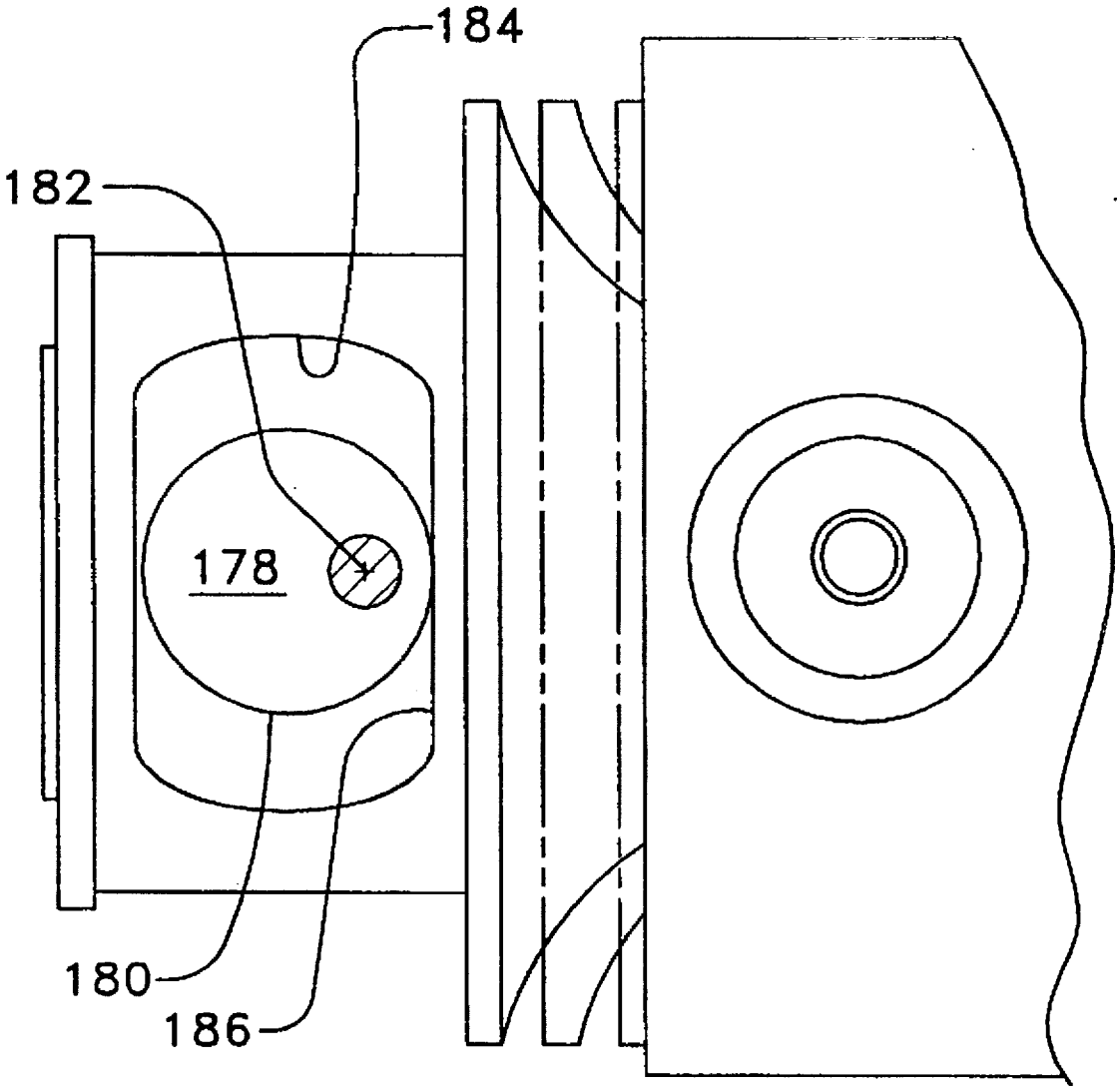
FIG. 4 is a view of the cam member for the actuating devise.

The plunger 150 is slidably movable along the injector axis 130 between an open position 170 and a closed position 172, designated by the phantom line in FIG. 2. In the open position 170 the first cavity 106 is in communication with the plenum 31 and air for combustion enters the combustion liner 38 through each of the first cavity 106 and the second cavity 132. Whereas, in the closed position 172 air for combustion enters the combustor liner 38 through only the second cavity 132. Thus, as the plunger 150 is moved intermediate the open position 170 and the closed position 172 the quantity of air for combustion is controlled to a plurality of preestablished positions 173, one of which being shown in phantom, each defining a different preestablished rate for combustion air to flow therethrough. The plunger 150 is movable to a variety of positions intermediate the open position 170 and the closed position 172. The movement of the plunger 150 is accomplished by an actuating device 174. The actuating device 174, in this application as best shown in FIGS. 2, 3 and 4, includes a shaft 176 having a pair of cam members 178 attached thereto. The cam members 178 define a cam surface 180 and have an offset center 182 through which the shaft 176 passes and is attached to each of the cam members 178. The cam members 178 are positioned in a elongate bore 184 positioned within the plunger 150 intermediate the first end portion 154 and the second end portion 156. The elongate bore 184 defines a contacting surface 186. Rotation of the shaft 176 causes the cam surface 180 to come in contact with the contacting surface 186 of the elongate bore 184 and movement of the plunger 150 from the closed position 172 to and intermediate the open position 170 is accomplished. For example, in this application, clockwise rotation causes the plunger 150 to move toward the closed position 172 and counter clockwise rotation causes the plunger 150 to move toward the open position 170.

Furthermore, the shaft 176 has an end extending external of the outer housing 18. The shaft 176 is rotated in an arcuate configuration by a rotating mechanism 192 of conventional design. For example, the rotating mechanism 192 could include a electrical motor, solenoid mechanism or a mechanical mechanism such as a gear arrangement or a cam arrangement. Furthermore, the rotating mechanism 192 can activate either a single fuel injection unit 28 or the rotating mechanism 192 can activate all or a portion of the fuel injection units 28.

Industrial Applicability

In operation, the gas turbine engine 10 is started in a conventional manner. As the engine 10 increases in speed and load demand from the driven device increases, more fuel and air is introduced to provide more power. For example, the amount or quantity of air from the compressor section 20 entering into the first cavity 106 of the fuel injection nozzles 28 is controlled by the actuating device 174. As the plunger 150 is moved between the open position 170 and the closed position 172 by the actuating device 174 the quantity of air to support combustion is varied.

Combustion air from the plenum 31 follows a dual path through the fuel injection nozzle 28. A small portion of the combustion air enters the second cavity 132, passes along the frustoconical contour increasing the velocity of the air and enters the plurality of swirlers 136. The plurality of swirlers 136 cause the air to take on a swirling motion prior to contacting the transition portion 135 wherein the swirling motion and velocity of the air is again increased. As the swirling air passes along the second cavity 132 toward the first end 122 of the core member 120 gaseous fuel is introduced thereto by the plurality of cross drilled holes 144 and mixes therewith prior to exiting into the combustion liner 38. The high velocity, swirling air and fuel provide a uniform mixture which supports complete and efficient burning within the combustion section 12. The majority of the air to support combustion enters into the controlled opening formed by the plunger 150. For example, air from the plenum 31 passes through the opening between the arcuate configuration of the end portion 80 of the first housing 72 and the arcuate surface of the frustoconical configuration of the second end portion 156 of the plunger 152. As the plunger 150 is moved from the open position 170 toward the closed position 172 the quantity of air is reduced.

In the startup and warm up condition, the plunger 150 is position in the open position 170 or nearly open position. Thus, the maximum amount of combustion air enters the first cavity 106. During the start and warm up condition the engine 10 is in a high emissions mode and uses only pilot fuel introduced through the plurality of holes 144. At a particular minimum power level, the actuating device 174 causes the plunger 150 to move toward the closed position 172 to one of the plurality of preestablished positions 173. At a position along the plurality of preestablished positions 173, the fuel supply is transferred to the gas or liquid from the pilot fuel to the plurality of spokes 118. The gaseous fuel is injected into the first cavity 106 through the plurality of spoke members 118. With the plunger 150 intermediate the open position 170 and the closed position 172, the required quantity or combustion air or preestablished rate of combustion air passes into the first cavity 106. Thus, the air/fuel ratio and the temperature within the combustor liner 38 is controlled and the formation of nitrogen oxide, carbon monoxide and unburned hydrocarbon is minimized. As the load on the engine 10 is increased, the amount of fuel injected into the combustion section 12 is increased, the fuel/air ratio changes and the combustion temperature within the combustor section 12 is increased. The results of the increase of combustion temperatures causes the temperature of the gases in the combustor primary zone to increase. To reduce these temperatures, the plunger 150 is moved toward the open position 170 by the actuating device 174. This increases the amount of combustion air entering the first cavity 106 and being directed within the combustion liner 38. In order to accelerate, the air/fuel ratio must change. In the air/fuel ratio, the relationship of the amount of fuel increases whereas the air remains constant. However, to control the temperature of combustion and the would be resulting increased emissions of nitrogen oxide, carbon monoxide and unburned hydrocarbon during combustion temperatures of generally between about 2700 to 3140 degrees Fahrenheit the plunger 150 moves according. The temperature of the gases entering the primary zone, or some other appropriate operating parameter (NOx, CO, T5, Pressure, ect) can be monitored frequently, directly or indirectly, and the actuating device 174 controls the position of the plunger 150 to maintain the 2700 to 3140 degrees Fahrenheit level. Thus, the emissions are controlled over the entire operating range of the engine 10.

Other aspects, objects and advantages of this invention can be obtained from a study of the drawings, the disclosure and the appended claims.

We claim:

1. A fuel injection nozzle defining an axis includes;

a first cavity being centered about said axis and defining an inlet end and an outlet end, said first cavity having a first preestablished cross-sectional area positioned near the inlet end and a second preestablished cross-sectional area positioned near the outlet end;

a fueling device through which fuel is introduced into said first cavity being positioned in said first preestablished cross-sectional area of said first cavity;

a swirling device through which a combustion air is swirled prior to having fuel introduced into said combustion air and being positioned within said first preestablished cross-sectional areas of said first cavity;

a second cavity being centered about said axis and positioned radially inwardly from said first cavity, said second cavity, during operation of the fuel injection nozzle, having a flow of combustion air flowing through said second cavity; and an actuating device being positioned radially about the second cavity and defining an open position and a closed position, said actuating device being operatively movable to a plurality of preestablished positions between said open position and said closed position, said actuating device being positioned at the inlet end of said first cavity.

2. The fuel injection nozzle of claim 1 wherein said second preestablished cross-sectional area of the first cavity is larger than the first preestablished cross-sectional area of the first cavity.

3. The fuel injection nozzle of claim 1 wherein said first cavity is formed by a first housing having an end portion defining a sealing portion thereon.

4. The fuel injection nozzle of claim 3 wherein said sealing portion has an arcuate configuration being defined by a radius.

5. The fuel injection nozzle of claim 4 wherein said actuating device has an end portion thereon having a sealing portion defined on said end portion.

6. The fuel injection nozzle of claim 5 wherein said sealing portion is defined by a radius.

7. The fuel injection nozzle of claim 6 wherein said radius forming said sealing portion on the first housing and the radius forming said sealing portion on said end portion of the actuating device are substantially equal.

8. The fuel injection nozzle of claim 5 wherein said end portion of said actuating device has a generally frustoconical configuration.

9. The fuel injection nozzle of claim 1 wherein said second cavity is positioned within a body member defining a first end and a second end, and a combustible fuel is introduce into said second cavity intermediate the first end and the second end.

10. The fuel injection nozzle of claim 9 wherein said second cavity has a plurality of swirler vanes positioned therein intermediate the first end and where said combustible fuel is introduced.

11. The fuel injection nozzle of claim 9 wherein said combustible fuel is introduce into the second cavity at an angle biased to the axis of the fuel injection nozzle.

12. The fuel injection nozzle of claim 1 wherein said first preestablished cross-sectional area and said second preestablished cross-sectional area has a transition area therebetween.

13. The fuel injection nozzle of claim 1 wherein said fueling device includes a plurality of spoke member through which only gaseous fuel is introduced into said first cavity.

14. The fuel injection nozzle of claim 1 where said first cavity is an annular cavity.

15. A gas turbine engine including a housing having a compressor section, a turbine section and a combustion section being operative interposed the compressor section and the turbine section positioned therein, a fuel injection nozzle being in communication with the combustor section and a source of fuel, a plenum being in communication with the compressor section, the combustor section and the fuel injection nozzle, said plenum being supplied with a compressed fluid to be mixed with the fuel within the fuel injection nozzle prior to entering into the combustion section;

said fuel injection nozzle including an axis, a first cavity being centered about said axis and defining an inlet end and an outlet end, said first cavity having a first preestablished cross-sectional area positioned near the inlet end and a second preestablished cross-sectional area positioned near the outlet end, a first fueling device through which fuel is introduced into said first cavity being positioned in said first preestablished cross-sectional area of said first cavity, a swirling device being positioned within said first preestablished cross-sectional area of said first cavity, a second cavity being centered about said axis and positioned radially inwardly from said first cavity; and an actuating device being positioned at the inlet end of said first cavity and defining an open position and a closed position, said actuating device being operatively movable to a plurality of preestablished positions between said open position and said closed position.

16. The gas turbine engine claim 15 wherein said second preestablished cross-sectional area of the first cavity is larger than the first preestablished cross-sectional area of the first cavity.

17. The gas turbine engine of claim 15 wherein said first cavity of the fuel injection nozzle is formed by a first housing having an end portion defining a sealing portion thereon.

18. The gas turbine engine of claim 17 wherein said sealing portion has an arcuate configuration being defined by a radius.

19. The gas turbine engine of claim 15 wherein said actuating device has an end portion thereon having a sealing portion defined on said end portion.

20. The gas turbine engine of claim 19 wherein said sealing portion is defined by a radius.

21. The gas turbine engine of claim 20 wherein said radius forming said sealing portion on the first housing and the radius forming said sealing portion on said end portion of said actuating device are substantially equal.

22. The gas turbine engine of claim 19 wherein said end portion of said actuating device has a generally frustoconical configuration..

23. The gas turbine engine of claim 15 wherein said second cavity is positioned within a body member defining a first end and a second end, and a combustible fuel is introduce into said second cavity intermediate the first end and the second end.

24. The gas turbine engine of claim 23 wherein said second cavity has a plurality of swirler vanes positioned therein intermediate the first end and where said combustible fuel is introduced.

25. The gas turbine engine of claim 23 wherein said combustible fuel is introduce into the second cavity at an angle biased to the axis of the fuel injection nozzle.

26. The gas turbine engine of claim 15 wherein said first preestablished cross-sectional area and said second preestablished cross-sectional area has a transition area therebetween.

27. The gas turbine engine of claim 15 wherein said fueling device includes a plurality of spoke member through which only gaseous fuel is introduced into said first cavity.

28. The gas turbine engine of claim 15 wherein said gas turbine engine includes a plurality of fuel injection nozzles and said actuating device includes a plunger positioned at the inlet end of the first cavity of each of the plurality of fuel injection nozzles.

29. The gas turbine engine of claim 28 wherein said actuating device actuates each of the plurality of fuel injection nozzles individually.

30. The gas turbine engine of claim 28 wherein said actuating device actuates each of the plurality of fuel injection nozzles as a combined unit.

31. The gas turbine engine of claim 15 wherein said first cavity is an annular cavity.

* * * * *